US005522620A

United States Patent [19]

Pracas

[11] Patent Number: 5,522,620

[45] Date of Patent: Jun. 4, 1996

[54] TRUCK FOR A RIDEABLE VEHICLE, SUCH AS A SKATEBOARD

[76] Inventor: Victor M. Pracas, Lot 11, Old Coast Road, Lake Clifton, Waroona, Western Australia, Australia, 6215

[21] Appl. No.: 108,674

[22] PCT Filed: Feb. 28, 1992

[86] PCT No.: PCT/AU92/00089

§ 371 Date: Oct. 27, 1993

§ 102(e) Date: Oct. 27, 1993

[87] PCT Pub. No.: WO92/15377

PCT Pub. Date: Sep. 17, 1992

[30] Foreign Application Priority Data

Mar. 1, 1991 [AU] Australia ..... PK4913

[51] Int. Cl.[6] ..... A63C 17/02

[52] U.S. Cl. ..... 280/87.041; 280/87.042; 280/11.27

[58] Field of Search ..... 280/11.27, 11.28, 280/87.041, 87.042; 16/35 R; 403/112, 113

[56] References Cited

U.S. PATENT DOCUMENTS

| | | | |
|---|---|---|---|
| 1,269,107 | 6/1918 | Moomaw | 280/87.041 |
| 1,467,453 | 9/1923 | Renacle | 280/87.042 |
| 1,809,609 | 1/1928 | Turner | 16/35 R |
| 2,114,586 | 10/1936 | Bowen | 16/35 R |
| 2,424,072 | 7/1947 | Allred | 280/11.28 |
| 2,542,829 | 2/1951 | Krausz | 280/11.28 |
| 2,632,652 | 3/1953 | Wintercorn | 280/11.28 |
| 3,235,282 | 2/1965 | Bostick | 280/11.27 |
| 3,505,878 | 3/1968 | Moll | 280/816 |
| 3,771,811 | 11/1973 | Bueno . | |
| 4,114,232 | 9/1978 | Uneda | 16/35 R |
| 4,202,559 | 5/1980 | Piazza | 280/87.042 |
| 4,228,928 | 10/1980 | Hocker et al. | 403/113 |
| 4,775,162 | 10/1988 | Chao | 280/87.041 |
| 4,776,604 | 10/1988 | Veldez et al. | 280/87.041 |
| 4,955,626 | 9/1990 | Smith et al. | 280/87.042 |
| 5,052,702 | 10/1991 | Chan | 280/87.042 |
| 5,263,725 | 11/1993 | Gesher et al. | 280/11.28 |

FOREIGN PATENT DOCUMENTS

| | | | |
|---|---|---|---|
| 2186501 | 8/1987 | United Kingdom | 280/87.042 |

*Primary Examiner*—Margaret A. Focarino
*Assistant Examiner*—Min Yu
*Attorney, Agent, or Firm*—Reising, Ethington, Barnard & Perry

[57] ABSTRACT

A skateboard truck (10) for a skateboard (100) having a pivotal member (12) which is arranged to be connected to the deck (102) of the skateboard. The pivotal member (12) carries the wheel assembly (13) of the truck (10). A locking mechanism (14) is also provided. In a first (unlocked) mode of operation, the pivotal member (12) is a able to pivot so that the truck (10) is movable in a to and fro manner. This first mode of operation permits a rider to perform advanced maneuvers using a skateboard (100). In a second (locked) mode of operation, the truck (10) is locked against such to and fro movement by the locking mechanism (14).

16 Claims, 4 Drawing Sheets

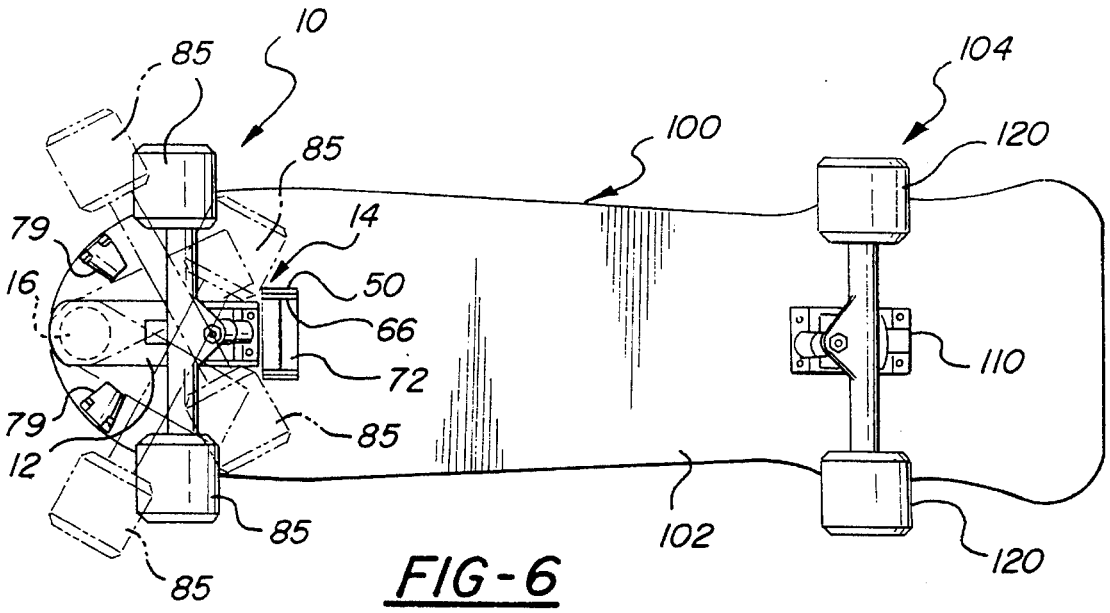
FIG-6
FIG-5
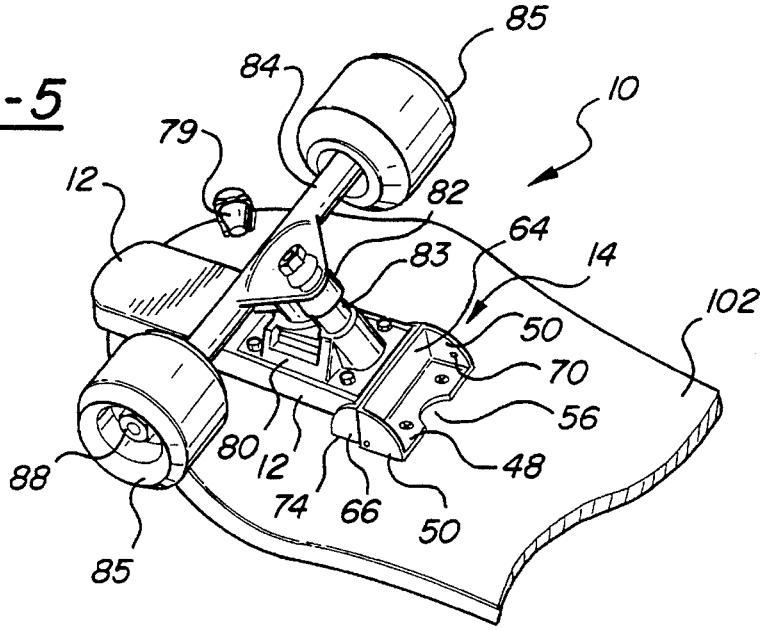

TRUCK FOR A RIDEABLE VEHICLE, SUCH AS A SKATEBOARD

DESCRIPTION

The present invention relates to a truck for a rideable vehicle, such as a skateboard. The truck of the present invention is arranged to be connected to the undersurface of a rideable vehicle, e.g., the deck of a skateboard.

FIELD OF THE INVENTION

Conventional rideable vehicles, such as skateboards, use a pair of trucks, one at the front and one at the rear of the rideable vehicle. These trucks carry the wheels of the vehicle and are rigidly mounted to the undersurface of the rideable vehicle. It is generally difficult for a rider to perform advanced riding manoeuvres on these conventional rideable vehicles, due to the limited performance capability of conventional trucks. Often, such advanced riding manoeuvres are not possible or can be performed only by very skilled riders.

In particular, conventional trucks do not readily permit a rider to use his/her body weight to try to impart a to and fro type movement to the truck to thereby propel the rideable vehicle.

The employment of this technique to move the rideable vehicle in a to and fro direction, i.e., propel the rideable vehicle, is made easier by the truck of the present invention. Thus, the truck of the present invention permits advanced riding manoeuvres to be more easily performed by a rider of a rideable vehicle, such as a skateboard.

SUMMARY OF THE INVENTION

In accordance with one aspect of the present invention there is provided a truck for a rideable vehicle comprising pivotal member means and a wheel assembly carried by said pivotal member means, said wheel assembly comprising at least two spaced apart wheels and said pivotal member means is arranged to be pivotally connected to said vehicle by pivotal connection means, wherein said pivotal connection means is provided at a first location of said truck, said wheel assembly is provided at a second location of said truck spaced from said first location and said pivotal member means is pivotal via said pivotal connection means such that said truck is moveable in a to and fro manner and, in use, enables a rider to propel said vehicle to which said truck is attached, in a forward directional along a surface.

BRIEF DESCRIPTION OF THE DRAWINGS

FIG. 5 is a perspective view of the front part of the skateboard shown in FIG. 1, showing the truck with the locking mechanism in its locking position; and FIG. 6 is an undersurface plan view of the skateboard shown in FIG. 1 with the locking mechanism in its non-locking position.

DESCRIPTION OF THE INVENTION

Figure 1:
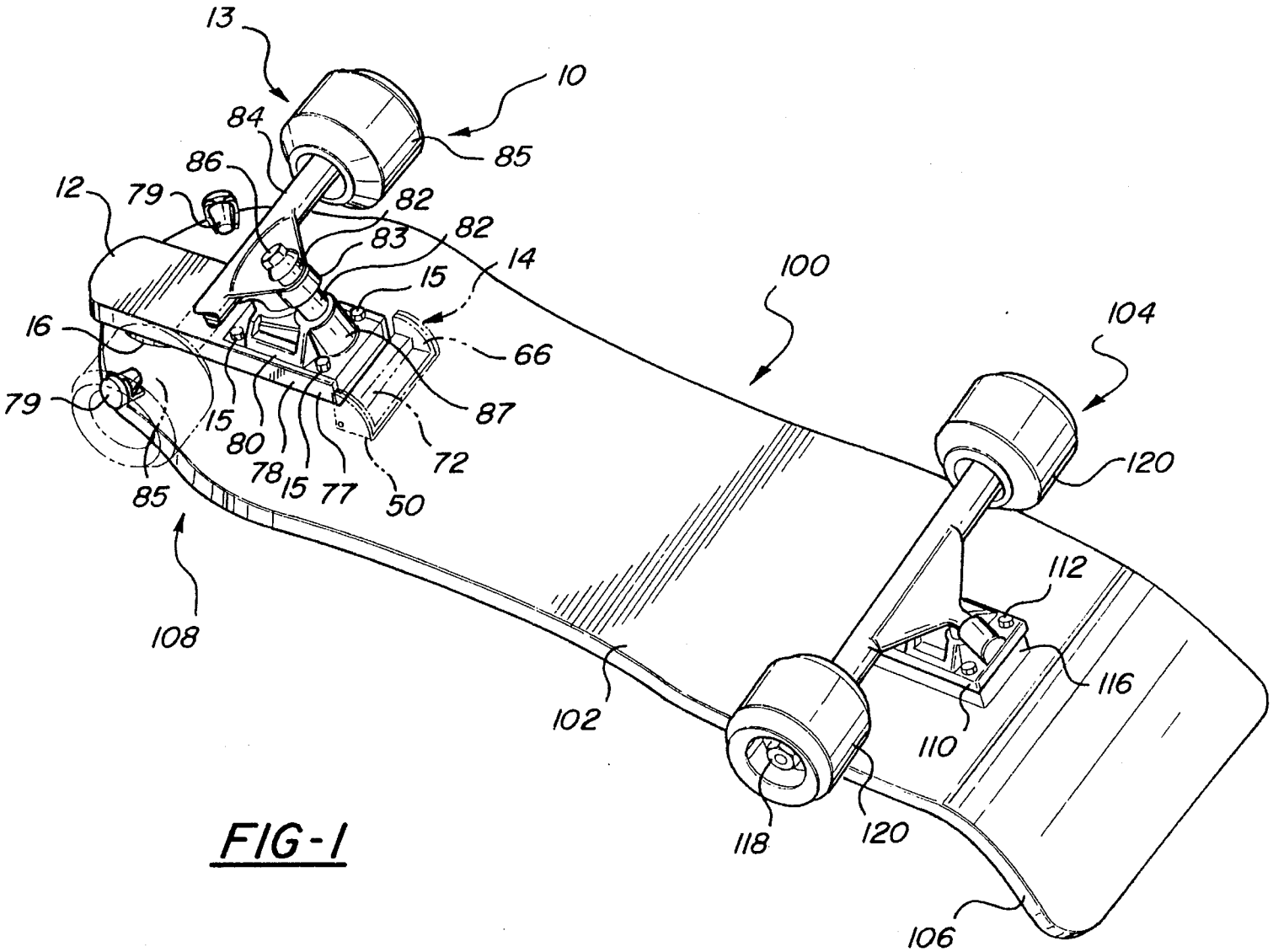
FIG. 1 is an under-surface perspective view of a skateboard incorporating an embodiment of a truck in accordance with the present invention.

In the drawings, there is shown a skateboard 100 incorporating a truck 10 in accordance with an embodiment of the present invention.

The truck 10 is provided at the front of the skateboard 100.

The skateboard 100 itself comprises a deck 102 and another (rear) truck 104 both of which may be of conventional form. The deck 102 may be provided with an upwardly inclined offset portion 106 at its rear end and a rounded tapered portion 108 near its front end. The truck 10 comprises a pivotal member 12 which carries the rest of the truck 10 including a wheel assembly 13, and a locking mechanism 14. The rest of the truck 10 is attached to the pivotal member 12 by bolts 15. The pivotal member 12 is arranged to be connected to the deck 102 of the skateboard 100.

A pivotal connection 16 is arranged to connect the pivotal member 12 to the deck 102 such that the pivotal member 12 is able to perform pivotal motion relative to the deck 102. The pivotal connection 16 is provided near one end of the pivotal member 12 and the rest of the truck 10 is provided near the other end of the pivotal member 12.

The pivotal connection 16 is arranged to be connected to the forward part of the deck 102, with the pivotal member 12 extending rearwardly.

Figure 2:
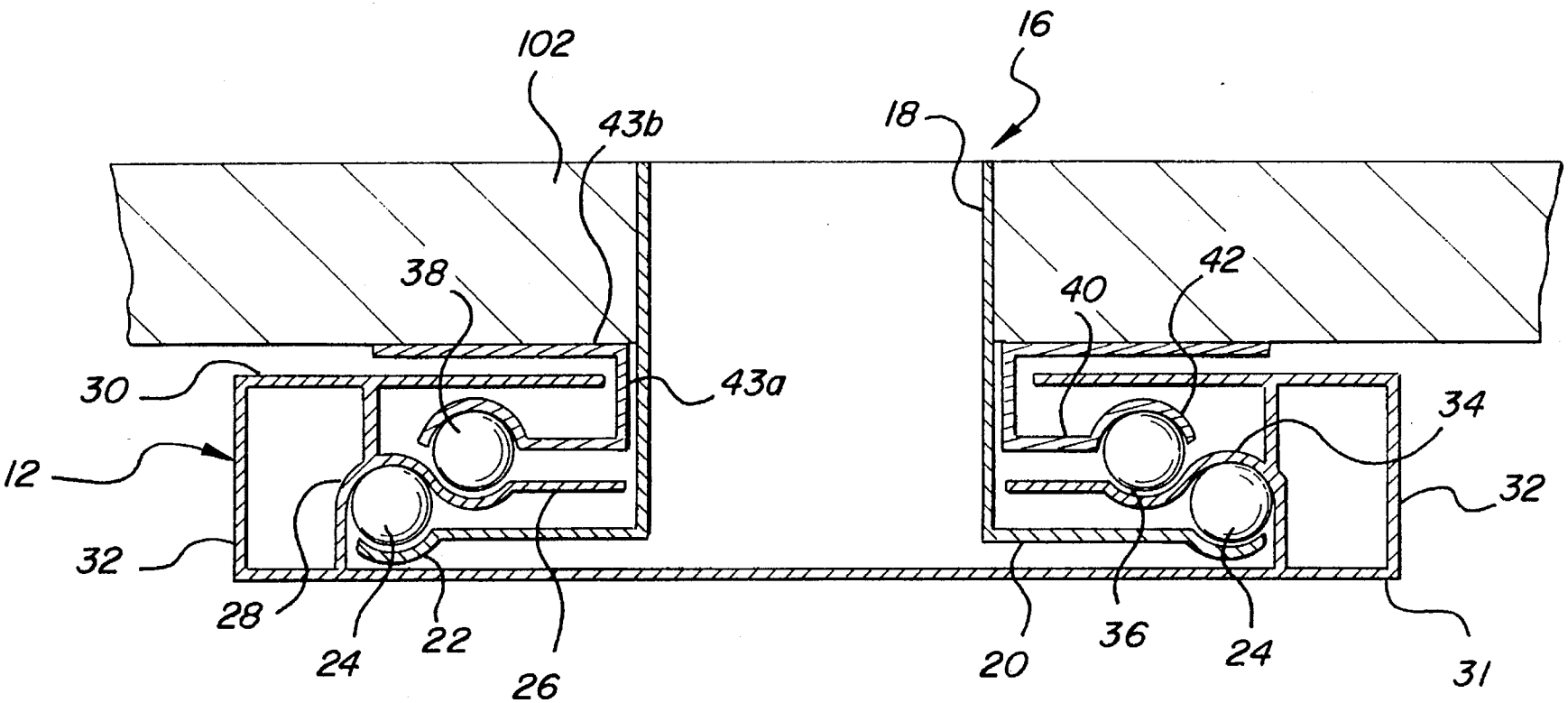
FIG. 2 is a cross-sectional elevation view of the pivotal connection along the line 2—2 of FIG. 4.
Figure 3:
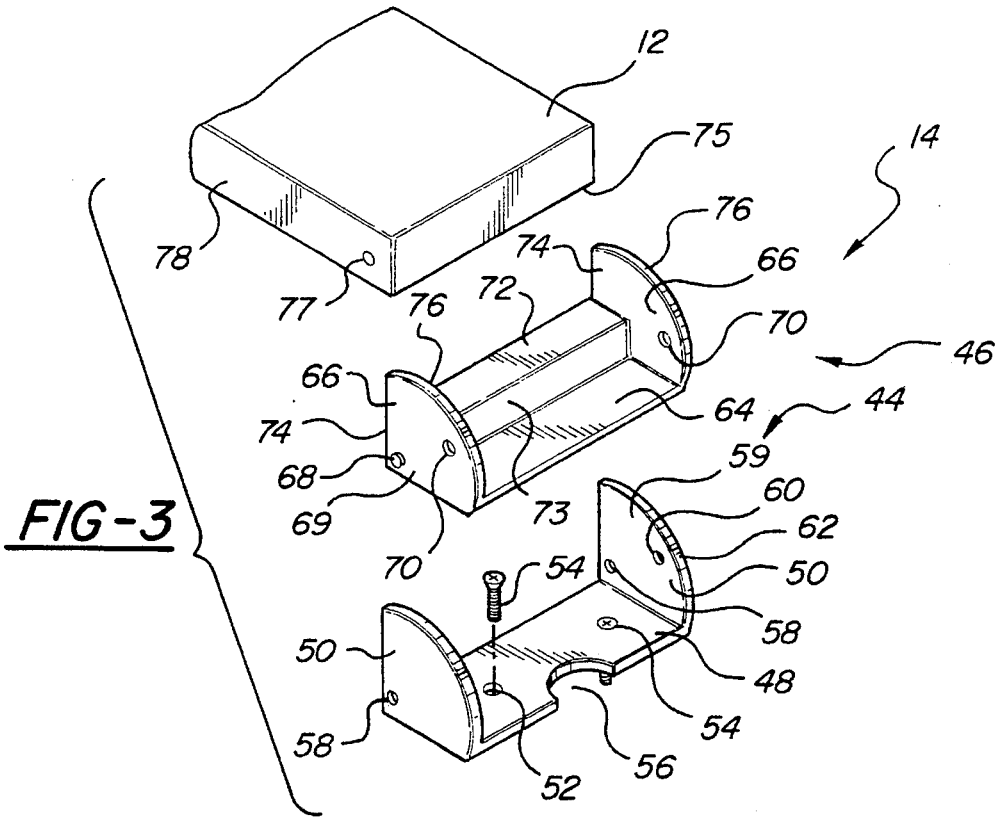
FIG. 3 is an exploded perspective view of the locking mechanism of the truck shown in FIG. 1.

An embodiment of the pivotal connection 16 is shown in FIG. 2.

The pivotal connection 16 shown in FIG. 2 comprises a short shaft or pin 18 which is arranged to be connected to the deck 102. The shaft 18 has a circular plate 20 connected at the end thereof in a transverse manner. The circular plate 20 has a circular groove 22 near the periphery thereof to accommodate a first set of ball bearings 24.

A circular plate 26 is supported in the pivotal member 12 by a web 28 that extends between upper and lower walls 30 and 31, respectively, of the pivotal member 12. The pivotal member 12 is also provided with an outer wall 32 which extends between the upper and lower walls 30 and 31. The circular plate 26 has a circular groove 34 to accommodate the first set of ball bearings 24.

Thus, the circular grooves 22 and 34 are in registration such that they form upper and lower circular grooves, respectively, to retain the first act of ball bearings 24. A further circular groove 36 is provided in the plate 26 adjacent the circular groove 34 (but on the opposite side of the circular plate 26) to accommodate a second set of ball bearings 38. Another circular plate 40 is provided above the second set of ball bearings 38 and is provided with a circular groove 42 to accommodate the second set of ball bearings 38.

Thus, the circular grooves 36 and 42 are in registration such that they form lower and upper circular grooves, respectively, to retain the second set of ball bearings 38. The circular plate 40 is connected to the deck 102 by portions 43*a* and 43*b*. The upper wall 30 is provided with an opening to accommodate the shaft 18 and portion 43*a*. When the pivotal member 12 pivots via the pivotal connection 16 only the circular plate 26, web 28 and walls 30, 31 and 32 move. The other parts of the pivotal connection 16 do not move.

The pivotal connection 16 permits the pivotal member 12 to pivot smoothly due to the dual arrangement of ball bearings 38 and 24 above and below, respectively, the circular plate 26.

The locking mechanism 14 comprises a bracket 44, arranged to be connected to the deck 102, and a locking member 46 pivotally held by the bracket 44. The bracket 44 comprises a base 48 and two side portions 50 extending therefrom. The base 48 is provided with apertures 52 such that screws 54 may be passed therethrough and into the deck 102 to connect the bracket 44 to the undersurface of the deck 102. The base 48 is also provided with a cut out 56.

The two side portions 50 are each provided with a hole 58 near one of their corners. These holes 58 are aligned. The inside faces 59 of the side portions 50 are each provided a pin 60 near a curved edge 62 thereof.

The locking member 46 comprises a base 64 and two side portions 66 extending therefrom. The two side portions 66 are each provided with a pin 68 extending from their outer faces 69, near one of their corners. The pins 68 are aligned.

The sides 66 are each provided with a hole 70. A locking block 72 is positioned between the two side portions 66 near straight edges 74 of the side portions 66 on the base 64.

The side portions 66 are provided with curved edges 76. The holes 70 are provided near the curved edges 76. The pins 68 of the locking member 46 locate in the holes 58 of the bracket 44 such that the locking member 46 is pivotal relative to the bracket 44.

The pins 60 on the side portions 50 of the bracket 44 may engage in the holes 70 of the side portions 66 of the locking member 46 to retain the locking member 46 in a non-locking position.

In the non-locking position, the pivotal member 12 is free to pivot and so the truck 10 is able to pivot.

In this non-locking position (shown in broken lines in FIG. 1, in solid shade lines at the right of FIGS. 4, and in 6), the curved edges 62 and 76 are aligned. The pivotal member 12 is provided with a pin 77 extending from each side 78 thereof.

The pins 77 engage in the holes 70 in the side portions 66 of the locking member 46 when the locking member 46 is pivoted to its locking position to retain and locking member 46 in its locking position.

Figure 4:
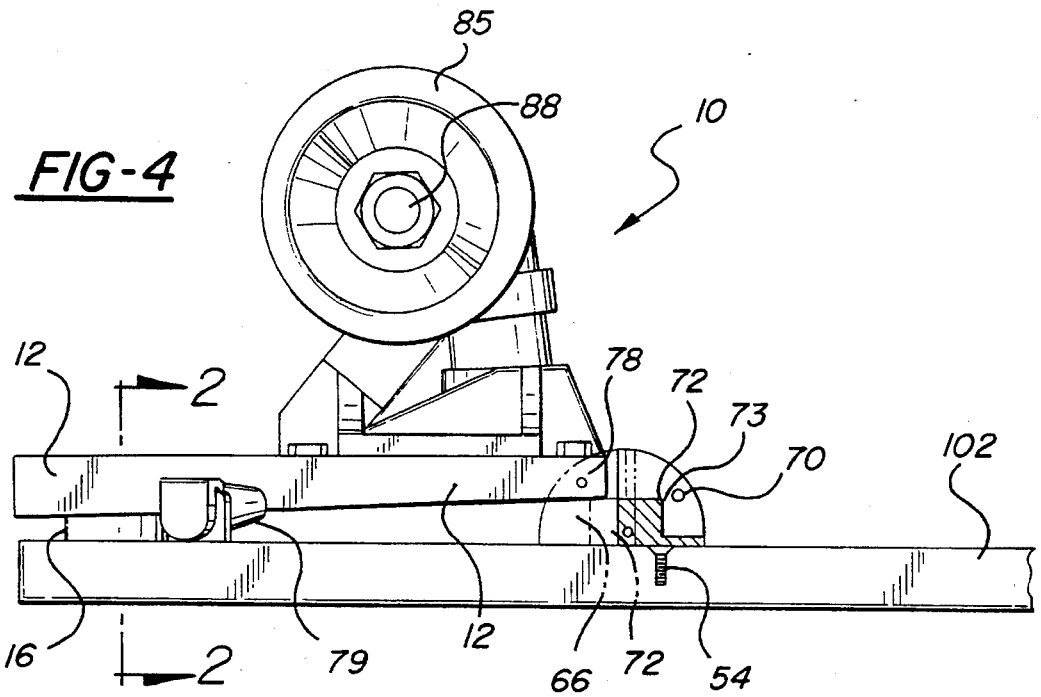
FIG. 4 is a side elevation view of the front part of the skateboard shown in FIG. 1, showing the truck with the locking mechanism in its locking position (and non-locking position)

In this locking position (shown at the left in FIG. 4 in broken shade lines and in FIG. 5), the side portions 66 of the locking member 46 are positioned adjacent the sides 78 of the pivotal member 12. The straight edges 74 of the side portions 66 and a surface of the locking block 72 are in substantial contact with the deck 102. A portion of the locking block 72 abuts with the surface of the pivotal member 12. This is best seen in FIG. 4.

In the locking position, the pivotal member 12 is unable to pivot, thereby preventing to and fro movement of the truck 10. This is because the side portions 66 abut with the sides 78 of the pivotal member 12 to prevent any sideways, or pivotal, movement of the pivotal member 12. Further, the locking block 72 abuts with the pivotal member 12, being positioned between the pivotal member 12 and the deck 102, to stabilize the pivotal member 12.

The cut-out 56 is provided in the base 48 to enable the locking member 46 to be easily pivoted from the non-locking position to the locking position by an operator using his/her finger to flick the locking member 46 into position. The locking block 72 has a rounded edge 73 to facilitate movement of the locking member 46 to and from the locking position past the edge 75 of the pivotal member 12. (As an alternative, the edge 75 of the pivotal member 12 may be rounded, and the edge 73 of the locking block 72 may be straight-edged.)

Stop members 79 may be provided to limit the movement of the pivotal member 12.

The stop members 79 are arranged to be connected to the underside of the deck 102 near the front end thereof, on respective sides of the pivotal member 12.

The remainder of the truck 10 may be of conventional form. Thus, the truck 10 may further comprise a mounting plate 80 connecting the remainder of the truck 10 to the pivotal member 102 by way of bolts 81; resilient portions 82 on either side of a collar 83 extending from a casing 84; the casing 84 encloses the axle-bearing shaft which carries the axles upon which the wheels 85 are mounted which together make up the wheel assembly 13; a bolt 86 extending through he resilient portions 82, collar 83, a sleeve 87 and into the mounting plate 80; along with nuts 88 to retain the wheels 85 on the truck 10.

Similarly, the truck 104 may be of conventional form. Thus, the truck 104 may comprise a mounting plate 110 connecting the truck 104 to the deck 102 by way of bolts 112 with an intermediate block 116 of resilient material, along with nuts 118 to retain the wheels 120 on the truck 104. The other parts of the truck 104 are obscured in FIG. 1, but it will be understood that these may be of conventional form, as hereinabove stated.

The preceding description of convention parts is provided by way of information even though they do not, in themselves, form part of the present invention. The manner of operation and use of a skateboard 100 incorporating a truck 10 in accordance with the present invention will now be described.

In the locking position of the locking member 46 of the locking mechanism 14 of the truck 10, the pivotal member 12 is unable to pivot. The truck 10 is thus locked against any to and fro side to side movement. Thus, the truck 10 functions as a conventional truck and the skateboard 100 may be ridden as a conventional skateboard.

When the locking member 46 is moved to its non-locking position, the pivotal member 12 is able to pivot by way of the pivotal connection 16 and the truck 10 is able to move in a pivotal, to and fro, side to side manner.

This to and fro swinging type motion of the truck 10 is limited by the stop members 79. The two extreme positions of the truck 10 are shown in broken lines in FIG. 6. When the non-locking position of the locking member 46 is engaged, a rider can stand on the deck 102 and by shifting his/her weight from side to side is able to get the skateboard 100 into motion such that it moves in a forward direction. The rider can do this without touching the ground with his/her foot.

The side to side movement of the rider causes the pivotal member 12 to pivot back and forth between the stop members 79 via the connection 16. This causes the truck 10 to also move in a corresponding to and fro swinging manner. This causes the skateboard 100 to move in a forward direction. The truck 10 of the present invention also permits the skateboard 100 to be forwardly moved along an incline. Accordingly, the truck of the present invention permits a rider to perform advanced riding manoeuvres on a skateboard.

Modifications and variations such as would be apparent to a skilled addressee are deemed within the scope of the present invention.

What is claimed is:

1. A truck for a rideable vehicle comprising an elongate pivotable member and a wheel assembly carried by said pivotable member adjacent a first end thereof, said wheel assembly comprising at least two spaced apart wheels, said pivotable member being provided with connecting means for pivotally connecting said pivotable member to an underside of the vehicle, said connecting means being located adjacent a second end of said pivotable member spaced from said wheel assembly whereby said wheel assembly carried by the pivotable member travels through an arc when the pivotable member is pivoted about said connecting means, a pair of stop members being provided on respective sides of said pivotable member to limit the angle of the arc through which said wheel assembly can travel and arranged so that the pivotable member is always oriented with the first end located rearwards of the connecting means when the vehicle is travelling in a forwards direction, wherein a to and fro movement of said pivotable member can be produced by a rider shifting his/her weight from side to side, said to and fro movement causing movement of the wheel assembly relative to said vehicle thereby enabling the rider to propel the vehicle in a forward direction without touching the ground with his/her foot.

2. A truck according to claim 1, wherein said connecting means comprises a shaft, a first plate arranged to be connected to said vehicle, a second plate connected to said pivotable member and a plurality of ball bearings provided between said first and second plates such that said pivotable member is pivotable via said connecting means.

3. A truck according to claim 1 further including locking means operatively connected to the vehicle and having a first mode of operation with said pivotable member being pivotal via said connecting means and said pivotable member to being movable in said to and fro manner, and in a second mode or operation with said pivotable member being prevented from moving in said to and fro manner by said locking means.

4. A truck according to claim 2 wherein a third plate is provided and is connected to said shaft, said shaft arranged to be connected to said vehicle and a first set of ball bearings is provided between said first and second plates and a second set of ball bearings is provided between said second and third plates such that said second plate is movable with said pivotable member.

5. A truck according to claim 2, wherein said first and second plates are provided with grooves to accommodate said sets of ball bearings.

6. A truck according to claim 3, wherein said locking means comprises a locking member movable between a first non-locking position in said first mode of operation and a second locking position in said second mode of operation in which said locking member engages with said pivotable member.

7. A truck according to claim 3, wherein said locking means is provided near said first end of said pivotable member.

8. A truck according to claim 4, wherein said first, second and third plates are provided with grooves to accommodate said sets of ball bearings.

9. A truck according to claim 6, wherein said locking member is provided with side portions which lie adjacent respective sides of said pivotable member in said second locking position.

10. A truck according to claim 6, wherein said locking member is provided with a locking block which is arranged to fit between said vehicle and said pivotable member in said second locking position.

11. A truck according to claim 6, wherein said locking means comprises a bracket arranged to be connected to said vehicle and said locking member is pivotally held by said bracket.

12. A truck according to claim 6, wherein first engaging means is provided on sides of said pivotable member and second engaging means is provided on side portions of said locking member, said side portions lying adjacent said sides of said pivotable member in said second locking position and wherein said first and second engaging means engage to releasably retain said locking member in said second locking position.

13. A truck according to claim 10, wherein one of said locking block and said pivotable member is provided with a rounded edge to facilitate movement of said locking block over an edge of said pivotable member.

14. A truck according to claim 11, wherein said locking member and said bracket are provided with second and third engaging means, respectively, which engage to releasably retain said locking means in said first non-locking position.

15. A truck according to claim 11, wherein said locking member and said bracket are provided with second and third engaging means, respectively, and said second engaging means is provided on side portions of said locking member and said third engaging means is provided on said portions of said bracket, said respective side portions lying adjacent one another in said first non-locking position.

16. A truck for a rideable vehicle comprising an elongate pivotable member and a wheel assembly carried by said pivotable member adjacent a first end thereof, said wheel assembly comprising at least two spaced apart wheels, said pivotable member being provided with pivotal connection for pivotally connecting said pivotable member to an underside of the vehicle, said pivotal connection being located adjacent a second end of said pivotable member spaced from said wheel assembly whereby said wheel assembly carried by the pivotable member travels through an arc when the pivotable member is pivoted about said pivotal connection, a pair of stop members being provided on respective sides of said pivotable member to limit the angle of the arc through which said wheel assembly can travel and arranged so that the pivotable member is always oriented with the first end located rearwards of the pivotal connection when the vehicle is travelling in a forwards direction, wherein a to and fro movement of said pivotable member can be produced by a rider shifting his/her weight from side to side, said to and fro movement causing movement of the wheel assembly relative to said vehicle thereby enabling the rider to propel the vehicle in a forward direction without touching the ground with his/her foot.

* * * * *